US011341920B2

(12) United States Patent
Liu et al.

(10) Patent No.: US 11,341,920 B2
(45) Date of Patent: May 24, 2022

(54) PIXEL CIRCUIT, DRIVING METHOD AND ELECTRONIC DEVICE

(71) Applicant: BOE Technology Group Co., Ltd., Beijing (CN)

(72) Inventors: Dongni Liu, Beijing (CN); Haoliang Zheng, Beijing (CN); Minghua Xuan, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/407,156

(22) Filed: Aug. 19, 2021

(65) Prior Publication Data

US 2022/0130335 A1 Apr. 28, 2022

(30) Foreign Application Priority Data

Oct. 28, 2020 (CN) ..... 202011174573.8

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0842* (2013.01);
(Continued)

(58) Field of Classification Search
CPC .. G09G 3/3233; G09G 3/3291; G09G 3/3258; G09G 3/3648; G09G 3/3266;
(Continued)

(56) References Cited

U.S. PATENT DOCUMENTS

2011/0193856 A1* 8/2011 Han ..... G09G 3/3233 345/214
2012/0154460 A1* 6/2012 Segawa ..... G09G 3/3233 345/690

(Continued)

FOREIGN PATENT DOCUMENTS

CN 106782313 A 5/2017
CN 107123394 A 9/2017
CN 111369941 A 7/2020

OTHER PUBLICATIONS

CN202011174573.8 first office action and search report.

*Primary Examiner* — Dong Hui Liang
(74) *Attorney, Agent, or Firm* — IPRO, PLLC

(57) ABSTRACT

A pixel circuit, a driving method thereof and electronic device, relates to the technical field of display configured for. The pixel circuit comprises a driving sub-circuit comprising a control terminal, a first terminal and a second terminal, the driving sub-circuit being configured to control a driving signal flowing through the first terminal and the second terminal according to a signal of the control terminal; a voltage division control sub-circuit configured to conduct voltage division on an input data signal in response to a first scanning signal to obtain a voltage division signal, and write the voltage division signal to the first terminal of the driving sub-circuit; and a compensation sub-circuit coupled to the control terminal of the driving sub-circuit and the second terminal of the driving sub-circuit, and configured to write voltage division signal passing through driving sub-circuit to control terminal of driving sub-circuit in response to first scanning signal.

18 Claims, 8 Drawing Sheets

(52) U.S. Cl.
CPC ..... *G09G 2310/0278* (2013.01); *G09G 2310/062* (2013.01)

(58) Field of Classification Search
CPC ..... G09G 3/3659; G09G 3/325; G09G 3/32; G09G 2300/0852; G09G 2300/0819; G09G 2300/0842; G09G 2300/0861; G09G 2320/043; G09G 2320/045; G09G 2320/0233; G09G 2310/0251; G09G 2310/0262
See application file for complete search history.

(56) References Cited

U.S. PATENT DOCUMENTS

| | | | | |
|---|---|---|---|---|
| 2016/0293105 | A1* | 10/2016 | Wang | G09G 3/3258 |
| 2017/0200417 | A1 | 7/2017 | Wu et al. | |
| 2018/0308426 | A1* | 10/2018 | Han | G09G 3/3258 |

* cited by examiner

PIXEL CIRCUIT, DRIVING METHOD AND ELECTRONIC DEVICE

CROSS REFERENCE TO RELEVANT DISCLOSURES

The present disclosure claims the priority of the Chinese patent disclosure filed on Oct. 28, 2020 before the Chinese Patent Office with the disclosure number of 202011174573.8 and the title of "PIXEL CIRCUIT, DRIVING METHOD AND ELECTRONIC DEVICE", which is incorporated herein in its entirety by reference.

TECHNICAL FIELD

The disclosure relates to the technical field of display, in particular to a pixel circuit, a driving method thereof and electronic device.

BACKGROUND

Light emitting components (e.g., LED, mini LED and microLED) are applied to light emitting devices, which may be panels using OLED, QLED, mini LED and microLED as display pixels.

SUMMARY

The embodiments of the disclosure provide a pixel circuit, a driving method thereof and electronic device.

In a first aspect, a pixel circuit is provided for providing a driving signal to an element to be driven. The pixel circuit comprises a driving sub-circuit comprising a control terminal, a first terminal and a second terminal, the driving sub-circuit being configured to control a driving signal flowing through the first terminal and the second terminal according to a signal of the control terminal; a voltage division control sub-circuit configured to conduct voltage division on an input data signal in response to a first scanning signal to obtain a voltage division signal, and write the voltage division signal to the first terminal of the driving sub-circuit; and a compensation sub-circuit coupled to the control terminal of the driving sub-circuit and the second terminal of the driving sub-circuit, and configured to write the voltage division signal passing through the driving sub-circuit to the control terminal of the driving sub-circuit in response to the first scanning signal.

Optionally, the driving sub-circuit comprises:

a driving transistor having a grid coupled to the control terminal of the driving sub-circuit, a first pole coupled to the first terminal of the driving sub-circuit, and a second pole coupled to the second terminal of the driving sub-circuit; and a storage capacitor comprising a first pole and a second pole, the first pole of the storage capacitor being coupled to a first signal terminal providing a first signal, and the second pole of the storage capacitor being coupled to the control terminal of the driving sub-circuit; and the voltage division control sub-circuit comprises:

a first capacitor comprising a first pole and a second pole, the second pole of the first capacitor being coupled to the first terminal of the driving sub-circuit; and a first transistor having a grid coupled to a first scanning terminal providing the first scanning signal, a first pole coupled to a data signal terminal providing a data signal, and a second pole coupled to the first pole of the first capacitor.

Optionally, the voltage division control sub-circuit further comprises:

a second capacitor comprising a first pole and a second pole, the first pole of the second capacitor being coupled to the second pole of the first capacitor; and a second transistor having a grid coupled to the first scanning terminal providing the first scanning signal, a first pole coupled to the first signal terminal, and a second pole coupled to the second pole of the second capacitor.

Optionally, the pixel circuit further comprises:

a first reset sub-circuit configured to reset the first pole and the second pole of the first capacitor in response to a second scanning signal.

Optionally, the first reset sub-circuit comprises a third transistor and a fourth transistor;

a grid of the third transistor is coupled to a second scanning terminal providing the second scanning signal, a first pole is coupled to the first pole of the first capacitor, and a second pole is coupled to the first signal terminal providing the first signal; and a grid of the fourth transistor is coupled to the second scanning terminal providing the second scanning signal, a first pole is coupled to the second pole of the first capacitor, and a second pole is coupled to the first signal terminal.

Optionally, the pixel circuit further comprises:

a switch control sub-circuit coupled between the voltage division control sub-circuit and the first terminal of the driving sub-circuit, the switch control sub-circuit being configured to control on-off of a signal transmission channel between the voltage division control sub-circuit and the first terminal of the driving sub-circuit in response to the first scanning signal.

Optionally, the switch control sub-circuit comprises a fifth transistor; and a grid of the fifth transistor is coupled to the first scanning terminal providing the first scanning signal, a first pole is coupled to the second pole of the first capacitor, and a second pole is coupled to the first terminal of the driving sub-circuit.

Optionally, the compensation sub-circuit comprises a sixth transistor; and the sixth transistor is coupled to the first scanning terminal providing the first scanning signal, a first pole is coupled to a second terminal of the driving sub-circuit, and a second pole is coupled to the control terminal of the driving sub-circuit.

Optionally, the pixel circuit further comprises:

a second reset sub-circuit configured to reset the control terminal of the driving sub-circuit and/or a first terminal of the element to be driven;

and/or, a light emission control sub-circuit configured to apply a voltage of a first voltage terminal to the first terminal of the driving sub-circuit in response to a light emission control signal to apply the driving signal to the element to be driven.

Optionally, the second reset sub-circuit comprises a seventh transistor and an eighth transistor;

a grid of the seventh transistor is coupled to the second scanning terminal providing the second scanning signal, a first pole is coupled to an initial signal terminal providing an initial signal, and a second pole is coupled to the control terminal of the driving sub-circuit; and a grid of the eighth transistor is coupled to the second scanning terminal, a first pole is coupled to the first terminal of the element to be driven, and a second pole is coupled to the initial signal terminal;

the light emission control sub-circuit comprises a ninth transistor and a tenth transistor;

a grid of the ninth transistor is coupled to a light emission control terminal providing the light emission control signal, a first pole is coupled to the first voltage terminal, and a second pole is coupled to the first terminal of the driving sub-circuit; and a grid of the tenth transistor is coupled to the light emission control terminal, a first pole is coupled to the second terminal of the driving sub-circuit, and a second pole is coupled to the first terminal of the element to be driven.

Optionally, the second reset sub-circuit comprises a seventh transistor and an eighth transistor;

a grid of the seventh transistor is coupled to the second scanning terminal providing the second scanning signal, a first pole is coupled to an initial signal terminal providing an initial signal, and a second pole is coupled to the control terminal of the driving sub-circuit; or a grid of the eighth transistor is coupled to the second scanning terminal, a first pole is coupled to the first terminal of the element to be driven, and a second pole is coupled to the initial signal terminal;

the light emission control sub-circuit comprises a ninth transistor and a tenth transistor;

a grid of the ninth transistor is coupled to a light emission control terminal providing the light emission control signal, a first pole is coupled to the first voltage terminal, and a second pole is coupled to the first terminal of the driving sub-circuit; and a grid of the tenth transistor is coupled to the light emission control terminal, a first pole is coupled to the second terminal of the driving sub-circuit, and a second pole is coupled to the first terminal of the element to be driven.

In a second aspect, electronic device is provided, comprising the pixel circuit as described in the first aspect and an element to be driven coupled to the pixel circuit.

Optionally, a switch control sub-circuit coupled between the voltage division control sub-circuit and the first terminal of the driving sub-circuit, the switch control sub-circuit being configured to control on-off of a signal transmission channel between the voltage division control sub-circuit and the first terminal of the driving sub-circuit in response to the first scanning signal.

In a third aspect, a driving method of the pixel circuit is provided, comprising the pixel is configured for providing a driving signal to an element to be driven, and the driving method of the pixel circuit comprises:

conducting, by the voltage division control sub-circuit, voltage division on an input data signal in response to a first scanning signal to obtain a voltage division signal, and writing the voltage division signal to the first terminal of the driving sub-circuit;

writing, by the compensation sub-circuit, the voltage division signal passing through the driving sub-circuit to the control terminal of the driving sub-circuit in response to the first scanning signal; and controlling, by the driving sub-circuit, the driving signal flowing through the first terminal and the second terminal according to a signal of the control terminal.

Optionally, the pixel circuit further comprises a switch control sub-circuit; and the driving method of the pixel circuit further comprises:

controlling, by the switch control sub-circuit, on-off of a signal transmission channel between the voltage division control sub-circuit and the first terminal of the driving sub-circuit in response to the first scanning signal.

Optionally, the pixel circuit further comprises a first reset sub-circuit and/or a second reset sub-circuit; and before conducting, by the voltage division control sub-circuit, voltage division on an input data signal in response to a first scanning signal to obtain a voltage division signal, and writing the voltage division signal to the first terminal of the driving sub-circuit, the driving method of the pixel circuit further comprises:

resetting, by the first reset sub-circuit, a first pole and a second pole of a first capacitor in response to a second scanning signal;

and, resetting, by the second reset sub-circuit, the control terminal of the driving sub-circuit and/or a first terminal of the element to be driven.

Optionally, the pixel circuit further comprises a first reset sub-circuit and/or a second reset sub-circuit; and before conducting, by the voltage division control sub-circuit, voltage division on an input data signal in response to a first scanning signal to obtain a voltage division signal, and writing the voltage division signal to the first terminal of the driving sub-circuit, the driving method of the pixel circuit further comprises:

resetting, by the first reset sub-circuit, a first pole and a second pole of a first capacitor in response to a second scanning signal;

or, resetting, by the second reset sub-circuit, the control terminal of the driving sub-circuit and/or a first terminal of the element to be driven.

Optionally, the pixel circuit further comprises a light emission control sub-circuit; and the driving method of the pixel circuit further comprises:

applying, by the light emission control sub-circuit, a voltage of a first voltage terminal to the first terminal of the driving sub-circuit in response to a light emission control signal, so that the driving sub-circuit controls the driving signal flowing through the first terminal and the second terminal according to the signal of the control terminal.

BRIEF DESCRIPTION OF THE DRAWINGS

In order to more clearly explain the technical solution in the embodiments of the disclosure, the following will briefly introduce the drawings needed in the description of the embodiments or the prior art. Obviously, the drawings in the following description are only some embodiments of the disclosure. For those of ordinary skill in the art, other drawings may be obtained according to the provided drawings without paying creative labor.

DETAILED DESCRIPTION

Figure 1:
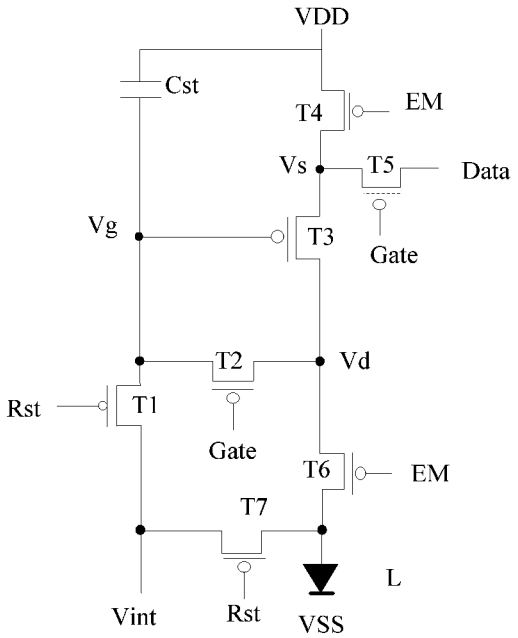
FIG. 1 is a pixel circuit provided by the related art.

Hereinafter, the technical solution in the embodiments of the disclosure will be described clearly and fully with reference to the drawings in the embodiments of the disclosure. Obviously, the described embodiments are only part of the embodiments of the disclosure, not all of the embodiments. Based on the embodiments of the disclosure, all other embodiments obtained by those of ordinary skill in the art without creative labor are within the scope of the disclosure.

In the description of the disclosure, it should be noted that the orientation or position relationship indicated by the terms "centric", "upper", "lower", "front", "rear", "left", "right", "vertical", "horizontal", "top", "bottom", "inner" and "outer" are based on the orientation or position relationship shown in the drawings, only for convenience of describing the disclosure and simplifying the description, and do not indicate or imply that the indicated device or element must have a specific orientation, or be constructed and operate in a specific orientation, and therefore may not be understood as a limitation of the disclosure.

Unless otherwise specified in the context, throughout the specification and claims, the term "comprise" and its other forms such as the third person singular form "comprises" and the present participle form "comprising" are interpreted as open and inclusive, that is, "including, but not limited to". In the description of the specification, the terms "one embodiment", "some embodiments", "exemplary embodiments", "example", "specific example" or "some examples", etc., are intended to indicate that specific features, structures, materials or characteristics related to this embodiment or example are included in at least one embodiment or example of the disclosure. Schematic representations of the above terms do not necessarily refer to the same embodiment or example. In addition, the specific features, structures, materials or characteristics described may be included in any one or more embodiments or examples in any suitable manner.

Hereinafter, the terms "first" and "second" are only configured for descriptive purposes, and may not be understood as indicating or implying relative importance or implicitly indicating the number of indicated technical features. Therefore, the features defined with "first" and "second" may include one or more of the features explicitly or implicitly. In the description of the embodiments of the disclosure, unless otherwise specified, the meaning of "a plurality of" is two or more.

In describing some embodiments, expressions like "coupled" and "connected" and their derivatives may be used. For example, the term "connected" may be used when describing some embodiments to indicate that two or more components have direct physical or electrical contact. For another example, the term "coupled" may be used when describing some embodiments to indicate that two or more components have direct physical or electrical contact. However, the term "coupled" or "communicatively coupled" may also mean that two or more components are not in direct contact with each other, but still cooperate or interact with each other. The embodiments disclosed herein are not necessarily limited to the contents herein.

The expression "A and/or B" includes the following three combinations: only A, only B, and the combination of A and B.

"Multiple" means at least two.

The phrase "used to" or "configured to" used herein has an open and inclusive meaning, which does not exclude devices used to or configured to perform additional tasks or steps.

In addition, the meaning of "based on" is open and inclusive because a process, step, calculation or other action "based on" one or more of the stated conditions or values may be based on additional conditions or values beyond the stated values in practice.

As used herein, "about" or "approximate" includes the stated value and the average value within the acceptable deviation range of a specific value, as determined by one of ordinary skill in the art in consideration of the measurement in question and the error related to the measurement of a specific quantity (i.e., the limitation of the measurement system).

In the related art, a current-driven active display panel comprises a light emitting component L and a pixel circuit driving the light emitting component L. As shown in FIG. 1, the pixel circuit may comprise seven thin film transistors and one capacitor. On this basis, combined with the signal timing diagram shown in FIG. 2, the working principle of the pixel circuit shown in FIG. 1 is illustrated in detail. The working principle of the pixel circuit may be divided into a reset stage, a data writing stage and a light emitting stage. Each stage will be described below.

Figure 2:
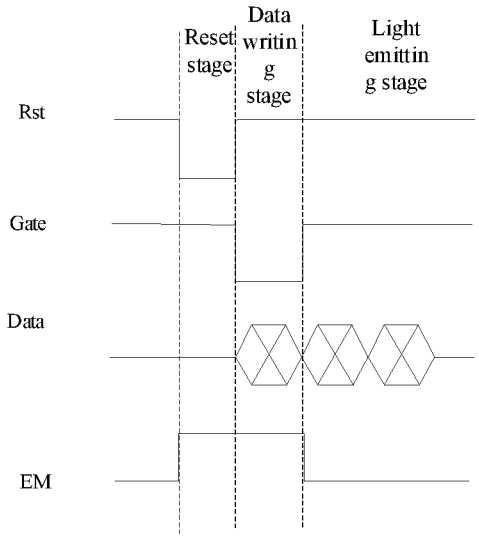
FIG. 2 is a timing diagram of a pixel circuit provided by the prior art.

In the reset stage, as shown in FIG. 2, because a reset signal from a reset terminal Rst inputs a low level signal, a first transistor T1 and a seventh transistor T7 are turned on to reset a grid of a driving transistor T3 and an anode of the light emitting component L, thereby eliminating the influence of a signal of a previous frame on the grid of the driving transistor T3 and the anode of the light emitting component L.

In the data writing stage, as shown in FIG. 2, because a scanning signal from a scanning signal terminal Gate inputs a low level signal, a fifth transistor T5 and a second transistor T2 are turned on to write a compensated data signal to the grid of the driving transistor T3, and at this point, the voltage at point G Vg=Vdata+Vth.

In the light emitting stage, as shown in FIG. 2, because a light emission signal from a light emitting terminal EM inputs a low level signal, a fourth transistor T4 and a sixth transistor T6 are turned on, so that a voltage from a first voltage terminal VDD is input to the anode of the light emitting component L via the fourth transistor T4, the driving transistor T3 and the sixth transistor T6, so that the light emitting component L emits light.

Figure 3:
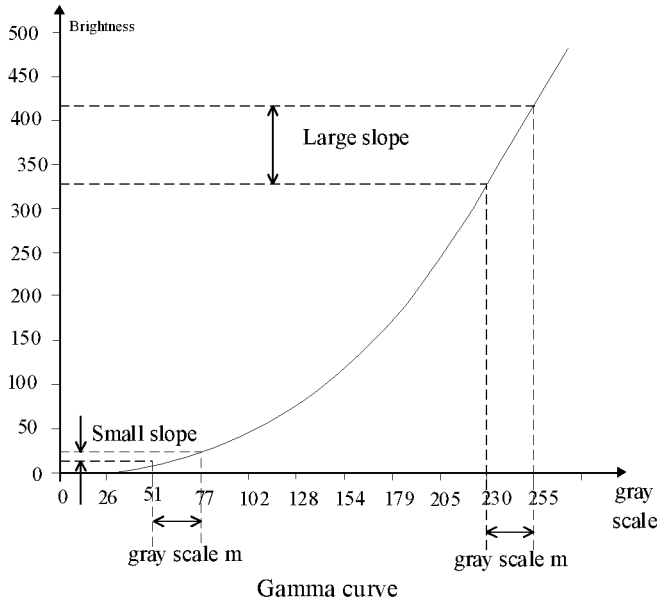
FIG. 3 is a Gamma graph provided by the related art.

FIG. 3 is a Gamma graph (Gamma curve) during gamma debugging, where the abscissa represents gray scale and the ordinate represents brightness, one brightness corresponds to one current and one current corresponds to one data voltage. It may be seen from FIG. 3 that the Gamma slope in high gray scale display is much larger than that in low gray scale display. Therefore, when different (e.g., two adjacent) high gray scale displays are performed, the distance between two corresponding data voltages is large, that is, data voltage precision is higher, while when different (e.g., two adjacent) low gray scale displays are performed, the distance between two corresponding data voltages is small, that is, data voltage precision is lower. That is to say, because the Gamma slope in high gray scale display is much larger than that in low gray scale display, smaller adjustment precision of data voltage is required in low gray scale display, so that low gray scale display may be fully realized. However, in pixel circuits provided by the related art, it is impossible to provide smaller adjustment precision of data voltage for low gray scale display, that is to say, the minimum voltage division ability of the data voltage of the pixel circuits provided by the related art is limited.

In order to solve the above problems, an embodiment of the disclosure provides electronic device, which comprises an element to be driven and a pixel circuit for providing a driving signal to the element to be driven. The element to be driven may be a light emitting component.

In some embodiments, the element to be driven may be a light emitting component, which may be a current-driven light emitting component, such as a light emitting diode (LED), a micro light emitting diode (Micro LED), a mini light emitting diode (Mini LED), an organic light emitting diode (OLED), etc. Of course, these light emitting components may also be voltage-driven light emitting components, which is not limited in this embodiment.

In this embodiment, the electronic device may be a light emitting device, and the light emitting device comprises a light emitting component and a pixel circuit for supplying an electrical signal to the light emitting component to drive the light emitting component to emit light. Of course, other parts may also be included, such as a control circuit for providing electrical signals to the pixel circuit, and the control circuit may comprise a printed circuit board and/or an integrated circuit electrically connected with a light emitting substrate.

In some embodiments, the light emitting device may be an illumination device, and in this case, the light emitting device is used as a light source to realize the illumination function. For example, the light emitting device may be a backlight module in a liquid crystal display device, a light configured for interior or exterior lighting, or various signal lamps.

In other embodiments, the light emitting device may be a display device for displaying an image (i.e., a picture). In this case, the light emitting device may comprise a display or a product comprising a display. The display may be a flat panel display (FPD) or a micro display. Based on whether a user may see the scene on the back of the display, displays are divided into transparent displays and opaque displays. Based on whether the display may be bent or rolled up, displays are divided into flexible displays and ordinary displays (which may be called rigid displays). By way of example, products comprising displays may include computer monitors, televisions, billboards, laser printers with a display function, telephones, mobile phones, personal digital assistants (PDA), laptop computers, digital cameras, portable camcorders, viewfinders, vehicles, large-area walls, theater screens or stadium signs, etc.

Figure 4:
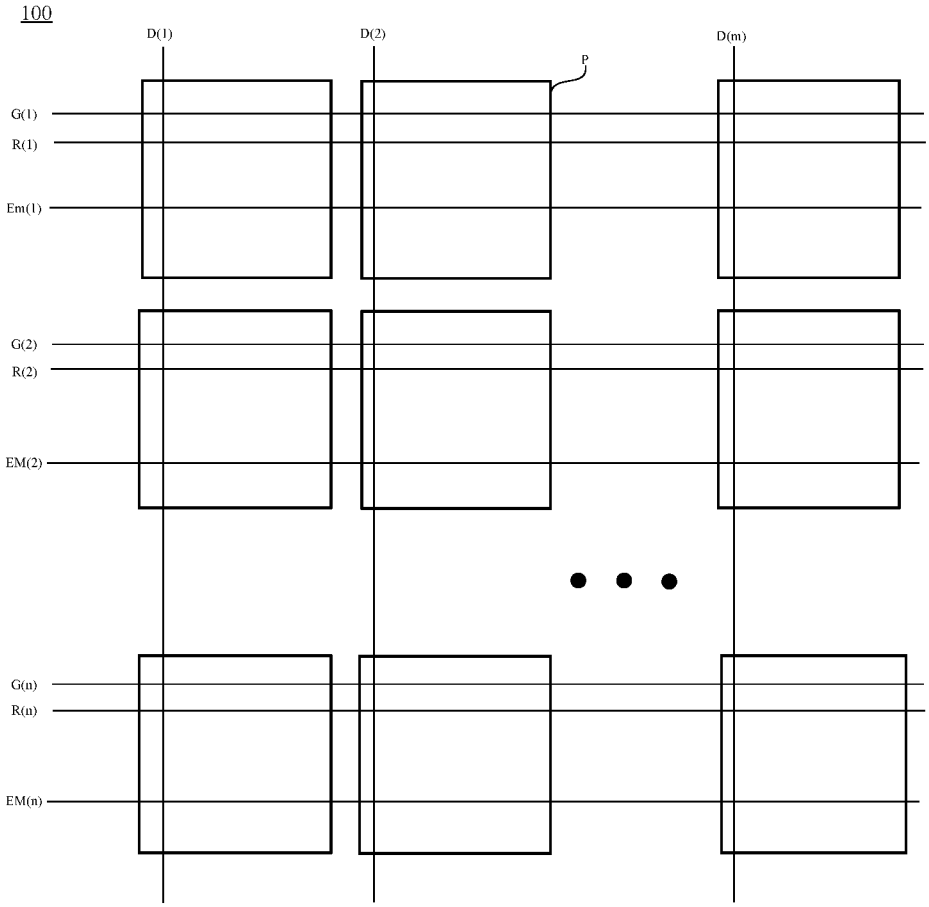
FIG. 4 is a diagram of a light emitting device provided by some embodiments of the disclosure.
Figure 5:
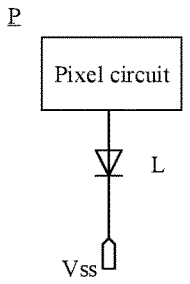
FIG. 5 is a schematic diagram of a sub-pixel provided by some embodiments of the disclosure.

The following description is based on the assumption that the light emitting device is a display device. As shown in FIG. 4, the light emitting device comprises a plurality of sub-pixels P. As shown in FIG. 5, at least one sub-pixel (for example, each sub-pixel) comprises a pixel circuit and an element to be driven L coupled thereto. The pixel circuits in each sub-pixel may be arranged into an array with n rows and m columns. The pixel circuit is used to drive the element to be driven L to work. A first terminal of the element to be driven L is coupled to the pixel circuit, and a second terminal of the element to be driven L is coupled to a second voltage terminal Vss.

On this basis, as shown in FIG. 4, the light emitting device 100 further comprises a plurality of first scanning signal lines G1(1)-G1(*n*), a plurality of second scanning signal lines R(1)-R(n), a plurality of data signal lines D(1)-D(m) and a plurality of light emission signal lines EM(1)-EM(n).

In this case, the pixel circuit may comprise a first scanning terminal Gate1, a second scanning terminal Rst, a light emission control terminal EM, and a data signal terminal Data. The plurality of first scanning signal lines provide first scanning signals for the first scanning terminal Gate1, the plurality of second scanning signal lines provide reset signals for the second scanning terminal Rst, the plurality of light emission signal lines provide light emission signals for the light emission control terminal EM, and the plurality of data signal lines provide data signals for the data signal terminal Data, thus providing the first scanning signals, the reset signals, the light emission signals and the data signals for the pixel circuit.

As shown in FIG. 4, the first scanning signal lines, the second scanning signal lines and the light emission signal lines are arranged in the row direction, and the data signal lines are arranged in the column direction. The sub-pixels in the same row share the first scanning signal lines, the second scanning signal lines and the light emission signal lines, and the sub-pixels in the same column share the data signal lines.

It should be noted that the arrangement of the plurality of signal lines included in the light emitting device described above and the wiring diagram of the light emitting device shown in FIG. 4 are only an example, and do not constitute a limitation on the structure of the light emitting device.

Figure 6:
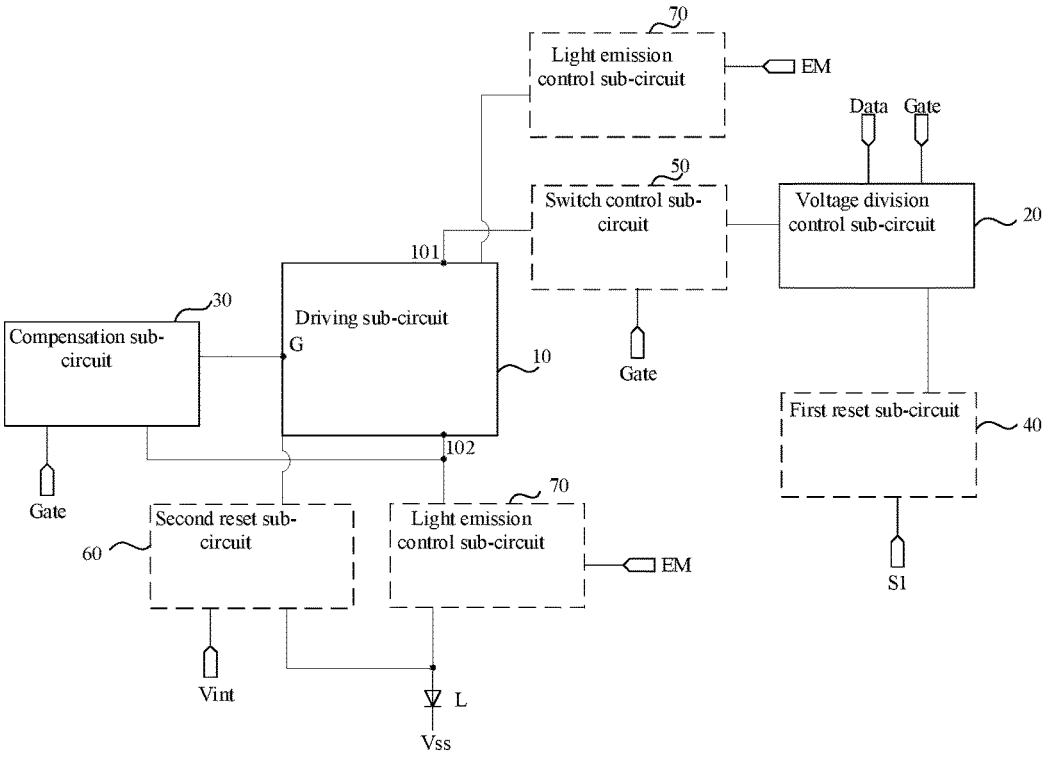
FIG. 6 is a module diagram of a pixel circuit provided by some embodiments of the disclosure.

An embodiment of the disclosure provides a pixel circuit for providing a driving signal to an element to be driven L. As shown in FIG. 6, the pixel circuit comprises a driving sub-circuit 10, a voltage division control sub-circuit 20 and a compensation sub-circuit 30.

The driving sub-circuit 10 comprises a control terminal G, a first terminal 101 and a second terminal 102. The driving sub-circuit 10 is configured to control a driving signal flowing through the first terminal 101 and the second terminal 102 according to a signal of the control terminal G.

The voltage division control sub-circuit 20 is configured to conduct voltage division on an input data signal to obtain a voltage division signal in response to a first scanning signal provided by a first scanning terminal Gate, and write the voltage division signal to the first terminal 101 of the driving sub-circuit 10.

The compensation sub-circuit 30 is coupled to the control terminal G of the driving sub-circuit 10 and the second terminal 102 of the driving sub-circuit 10, and is configured to write the voltage division signal passing through the driving sub-circuit 10 to the control terminal G of the driving sub-circuit in response to the first scanning signal provided by the first scanning terminal Gate.

On this basis, the data signal input to the voltage division control sub-circuit 20 may be subjected to voltage division by the voltage division control sub-circuit 20, and the voltage division data signal may be written into the first terminal 101 of the driving sub-circuit 10, so that the first terminal 101 of the driving sub-circuit 10 may obtain the voltage division data signal. With the arrangement of the compensation sub-circuit 30, the voltage division signal passing through the driving sub-circuit 10 may be written into the control terminal G of the driving sub-circuit 10. In this way, a signal of the control terminal of the driving sub-circuit will change, for example, the signal of the control terminal of the driving sub-circuit will decrease, so as to provide a light emitting device with smaller adjustment precision of data voltage required for realizing low gray scale display, thereby fully realizing low gray scale display and further improving the display effect.

Figure 7:
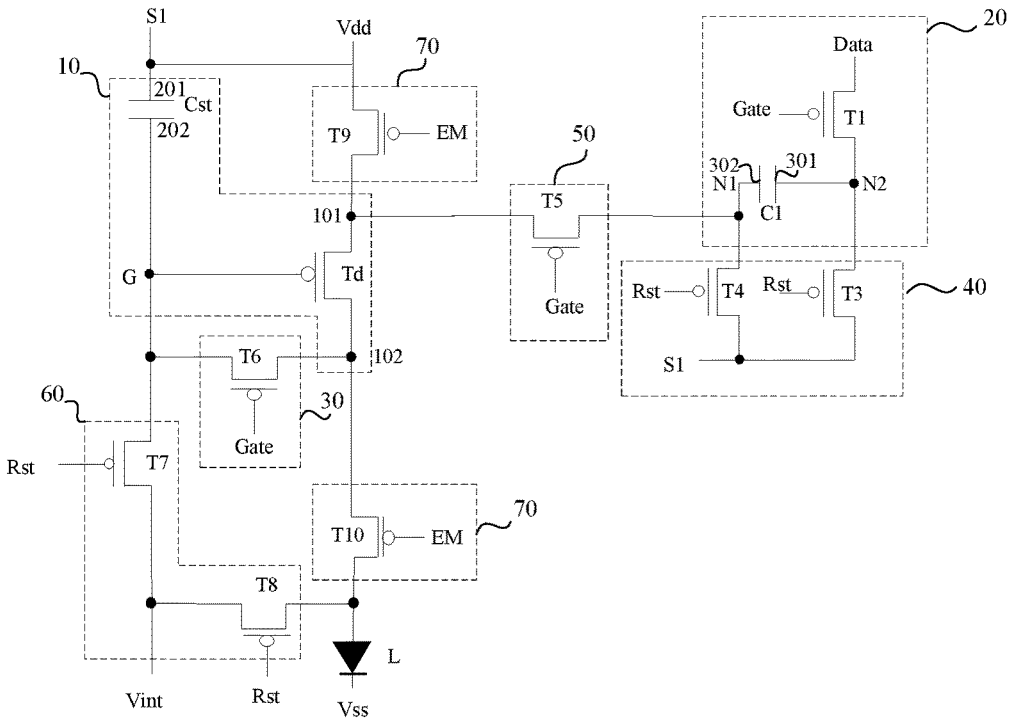
FIG. 7 is a diagram of a pixel circuit provided by some embodiments of the disclosure.

In some embodiments, as shown in FIG. 7, the driving sub-circuit 10 comprises a driving transistor Td and a storage capacitor Cst, and the voltage division control sub-circuit 20 comprises a first capacitor C1 and a first transistor T1.

A grid of the driving transistor Td is coupled to the control terminal G of the driving sub-circuit 10, a first pole is coupled to the first terminal of the driving sub-circuit 10, and a second pole is coupled to the second terminal of the driving sub-circuit 10.

The storage capacitor Cst comprises a first pole 201 and a second pole 202. The first pole 201 of the storage capacitor Cst is coupled to a first signal terminal S1 providing a first signal, and the second pole 202 of the storage capacitor Cst is coupled to the control terminal G of the driving sub-circuit 10.

The first capacitor C1 comprises a first pole 301 and a second pole 302, and the second pole 302 of the first capacitor C1 is coupled to the first terminal 101 of the driving sub-circuit 10.

A grid of the first transistor T1 is coupled to a first scanning terminal Gate providing a first scanning signal, a first pole of the first transistor T1 is coupled to a data signal terminal Data providing a data signal, and a second pole of the first transistor T1 is coupled to the first pole 301 of the first capacitor C1. After T1 is turned on, the data signal provided by the data signal terminal Data may be written to the first pole 301 of the first capacitor C1.

As shown in FIG. 7, the voltage division control sub-circuit 20 is coupled to the first terminal 101 of the driving sub-circuit 10, the data signal terminal Data and the first scanning terminal Gate1. The data signal terminal Data provides the data signal, and the first scanning terminal Gate1 provides the first scanning signal.

In some embodiments, as shown in FIG. 6, the pixel circuit further comprises a first reset sub-circuit 40 configured to reset the first pole 301 and the second pole 302 of the first capacitor C1 in response to a second scanning signal provided by a second scan terminal Rst.

Specifically, as shown in FIG. 7, the first reset sub-circuit 40 comprises a third transistor T3 and a fourth transistor T4.

A grid of the third transistor T3 is couple to the second scanning terminal Rst providing the second scanning signal, a first pole is coupled to the first pole 301 of the first capacitor C1, and a second pole is coupled to the first signal terminal S1 providing the first signal. After T3 is turned on, the first signal provided by the first signal terminal S1 may be written to the first pole 301 of the first capacitor C1 to reset the first pole 301 of the first capacitor C1.

A grid of the fourth transistor T4 is coupled to the second scanning terminal Rst providing the second scanning signal, a first pole is coupled to the second pole 302 of the first capacitor C1, and a second pole is coupled to the first signal terminal S1. After T4 is turned on, the first signal provided by the first signal terminal S1 may be written to the second pole 302 of the first capacitor C1 to reset the second pole 302 of the first capacitor C1.

As shown in FIG. 7, the second pole 302 of the first capacitor C1 is coupled to a first node N1, and the first pole 301 of the first capacitor C1 is coupled to a second node N2. That is, the first node N1 is coupled to the first terminal 101 of the driving sub-circuit 10 and the first pole of the fourth transistor T4, and the second node N2 is coupled to the second pole of the first transistor T1, the first pole of the third transistor T3 and the first pole 301 of the first capacitor C1.

In some embodiments, as shown in FIG. 7, the compensation sub-circuit 30 comprises a sixth transistor T6, a grid of the sixth transistor T6 is coupled to the first scanning terminal Gate providing the first scanning signal, a first pole is coupled to the second terminal 102 of the driving sub-circuit 10, and a second pole is coupled to the control terminal G of the driving sub-circuit 10.

In some embodiments, as shown in FIG. 6, the pixel circuit further comprises a second reset sub-circuit 60 and a light emission control sub-circuit 70.

In some other embodiments, the pixel circuit may further comprise any one of the second reset sub-circuit 60 and the light emission control sub-circuit 70. That is, the pixel circuit comprises the second reset sub-circuit 60, or the pixel circuit comprises the light emission control sub-circuit 70.

The second reset sub-circuit 60 is configured to reset the control terminal G of the driving sub-circuit 10 and a first terminal of the element to be driven L, or the second reset sub-circuit 60 is configured to reset the control terminal G of the driving sub-circuit 10 or the first terminal of the element to be driven L.

Specifically, as shown in FIG. 7, the second reset sub-circuit comprises a seventh transistor T7 and an eighth transistor T8.

A grid of the seventh transistor T7 is coupled to the second scanning terminal Rst providing the second scanning signal, a first pole is coupled to an initial signal terminal Vint providing an initial signal, and a second pole is coupled to the control terminal G of the driving sub-circuit 10. After T7 is turned on, the initial signal provided by the initial signal terminal Vint may be written to the control terminal G of the driving sub-circuit 10 to reset the control terminal G of the driving sub-circuit 10.

A grid of the eighth transistor T8 is coupled to the second scanning terminal Rst, a first pole is coupled to the first terminal of the element to be driven L, and a second pole is coupled to the initial signal terminal Vint. After T8 is turned on, the initial signal provided by the initial signal terminal Vint may be written to the first terminal of the element to be driven L to reset the first terminal of the element to be driven L.

Figure 8:
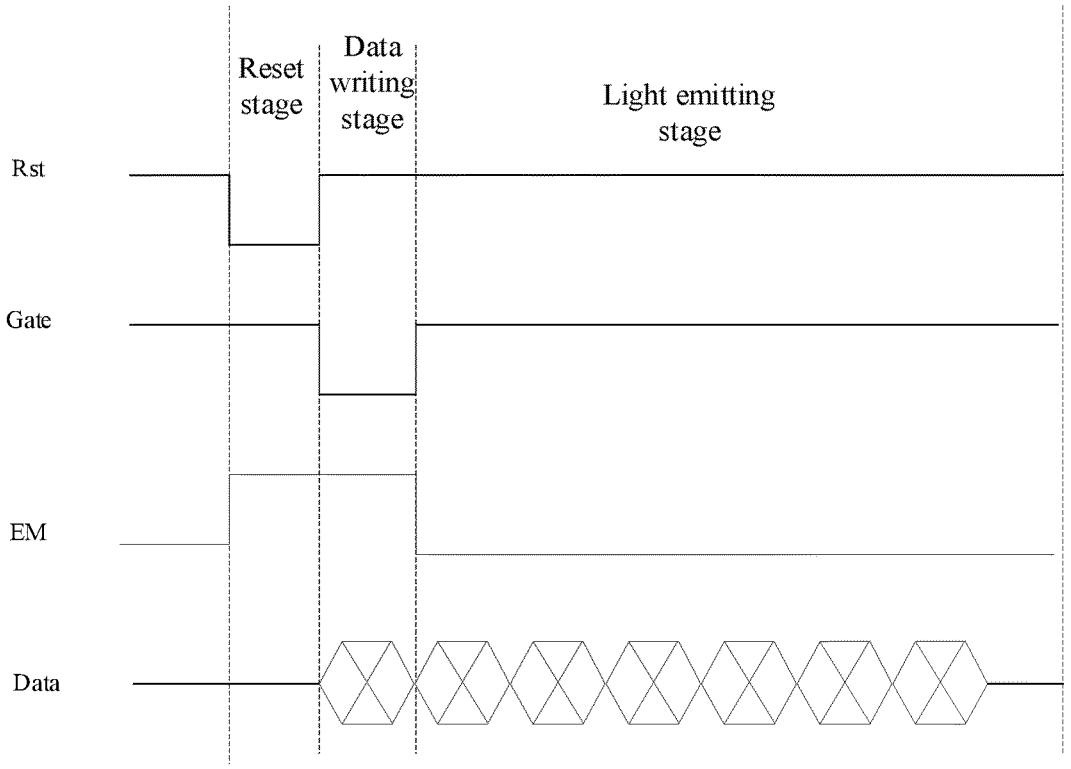
FIG. 8 is a timing diagram of a pixel circuit provided by some embodiments of the disclosure.

It should be noted that FIG. 8 is based on the assumption that the second reset sub-circuit 60 comprises the seventh transistor T7 and the eighth transistor T8. In actual design and manufacture, the second reset sub-circuit 60 may only comprise the seventh transistor T7 or the eighth transistor T8, which is not limited by this embodiment.

The light emission control sub-circuit 70 is configured to apply a voltage of a first voltage terminal Vdd to the first terminal 101 of the driving sub-circuit 10 in response to a light emission control signal provided by a light emission control terminal EM, so as to apply the driving signal to the element to be driven L, thereby causing the element to be driven L to work.

Specifically, the light emission control sub-circuit 70 comprises a ninth transistor T9 and a tenth transistor T10.

A grid of the ninth transistor T9 is coupled to the light emission control terminal EM providing the light emission control signal, a first pole is coupled to the first voltage terminal Vdd, and a second pole is coupled to the first terminal 101 of the driving sub-circuit. After T9 is turned on, the first voltage signal provided by the first voltage terminal Vdd may be written to the first terminal 101 of the driving sub-circuit 10.

A grid of the tenth transistor T10 is coupled to the light emission control terminal EM, a first pole is coupled to the second terminal 102 of the driving sub-circuit 10, and a second pole is coupled to the first terminal of the element to be driven L. After T10 is turned on, the first voltage signal may be written to the first terminal of the element to be driven L.

It should be noted that the first electrodes of the above transistors may be drain electrodes and the second electrodes may be source electrodes, or the first electrodes may be source electrodes and the second electrodes may be drain electrodes, which is not limited by this embodiment.

In the circuit provided by the embodiment, the transistors are all assumed to be P-type transistors. It should be noted that this embodiment includes but is not limited to this. For example, one or more transistors in the circuit provided in this embodiment may also be N-type transistors, as long as the poles of the selected type of transistors are connected correspondingly with reference to the poles of the corresponding transistors in this embodiment, and the corresponding voltage terminals provide corresponding high voltages or low voltages.

On this basis, with reference to the signal timing diagram shown in FIG. 8, the working principle of the pixel circuit shown in FIG. 7 is illustrated in detail. The working principle of the pixel circuit may be divided into a reset stage, a data writing stage and a light emitting stage. Each stage will be described below.

In the reset stage, as shown in FIG. 8, because the second scanning terminal Rst is input with a low level signal, the third transistor T3, the fourth transistor T4, the seventh transistor T7 and the eighth transistor T8 are turned on, so that the first signal Vcom from the first signal terminal S1 is input to the first pole 301 of the first capacitor C1 (i.e., the second node N2), the second pole 302 of the first capacitor C1 (i.e., the first node N1), the control terminal G of the driving sub-circuit 10 and the first terminal of the element to be driven L (the anode of the light emitting component), so as to reset the first node N1, the second node N2, the control terminal G of the driving sub-circuit 10 and the anode of the light emitting component, thus eliminating the influence of the signal of the previous frame on the first node N1, the second node N2, the control terminal G of the driving sub-circuit 10 and the anode of the light emitting component.

Figure 9A:
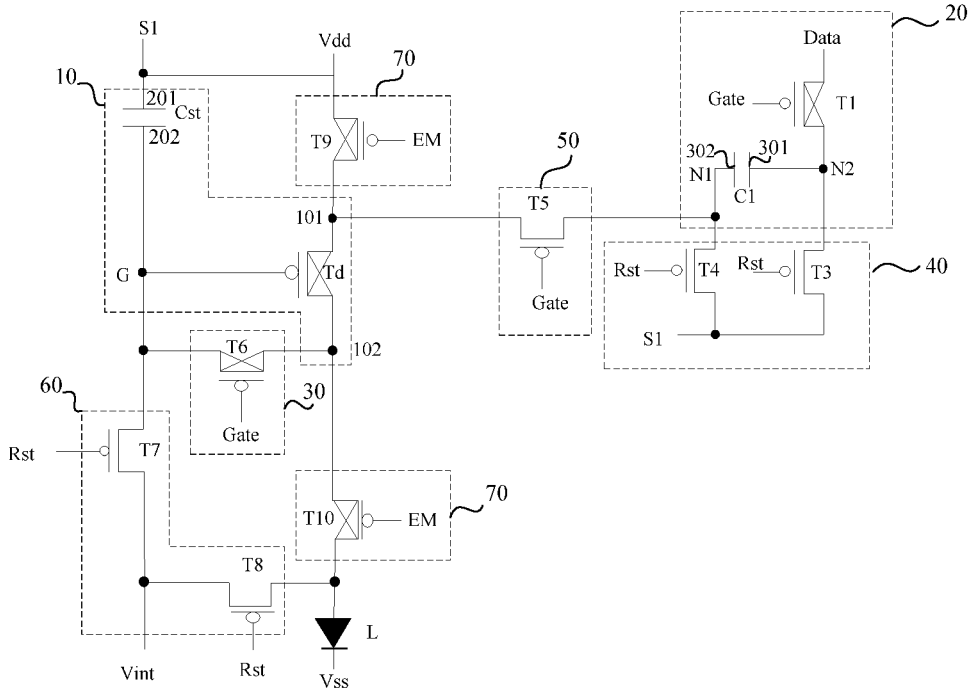
FIG. 9A is a stage diagram of a pixel circuit provided by some embodiments of the disclosure.

As shown in FIG. 9A, a low level signal is input to the second scanning terminal Rst, the third transistor T3, the fourth transistor T4, the seventh transistor T7 and the eighth transistor T8 are all in an on state, and the driving transistor Td, the first transistor T1, the sixth transistor T6, the ninth transistor T9 and the tenth transistor T10 are all in an off state.

In the data writing stage, as shown in FIG. 8, the first transistor T1 is turned on because a low level signal is input to the first scanning terminal Gate, so that the data signal from the data signal terminal Data is transmitted to the first pole 301 of the first capacitor C1, and the voltage division data signal $$V_{N1} = \left[\frac{Cst}{(C1 + Cst)}\right] * (V_{Data} - V_{com})$$

of the first node N1 may be obtained according to the capacitance division principle of the storage capacitor Cst and the first capacitor C1. When $V_{com}$=0V, the voltage at the first node N1$V_{N1}$=0.5·$V_{Data}$. It may be understood that by setting the proportional relationship between the capacitance of the storage capacitor Cst and the capacitance of the first capacitor C1, the voltage of the first node N1 may be set as the divided voltage of other proportions of the data signal $V_{Data}$ provided by the data signal terminal Data, which belongs to the design idea provided by this embodiment of the disclosure.

Since the first scanning terminal Gate inputs a low level signal, the sixth transistor T6 is turned on to write the voltage division signal passing through the driving sub-circuit 10 into the control terminal G of the driving sub-circuit 10. At this point, the voltage of the control terminal G of the driving sub-circuit 10 $V_G$=0.5·$V_{Data}$+$V_{th}$.

In some embodiments, in the fabrication of specific light emitting devices, metal in the same layer as a certain electrode of a transistor may be used as a polar plate of a capacitor, so as to maximize the use of an existing film layer of a back plate, save design space and achieve a better display effect.

Figure 9B:
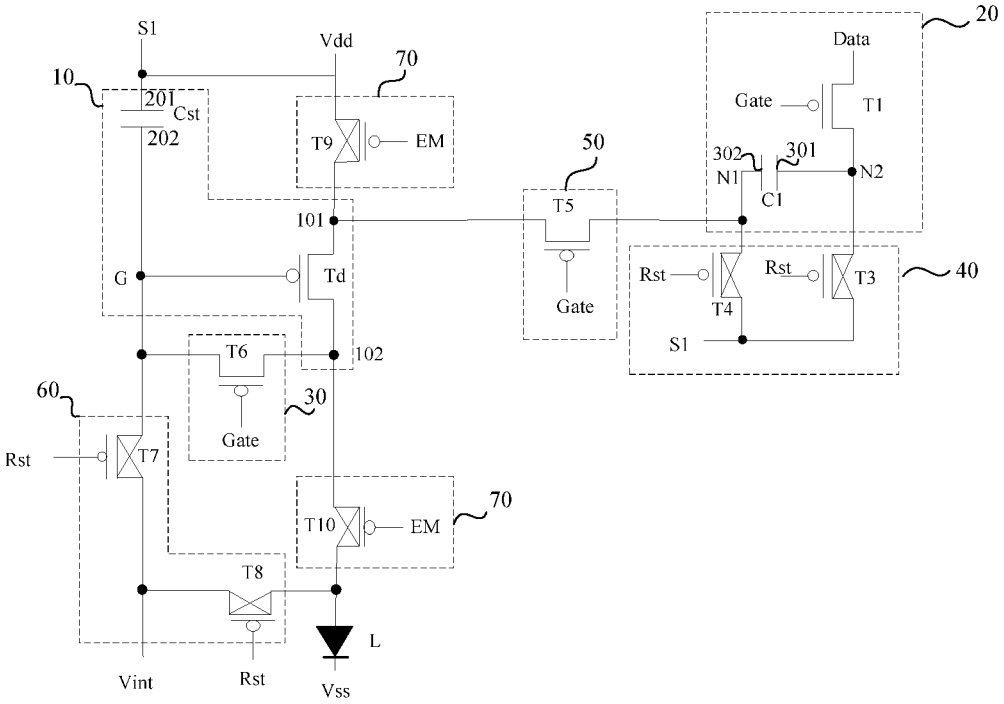
FIG. 9B is a stage diagram of another pixel circuit provided by some embodiments of the disclosure.

As shown in FIG. 9B, a low level signal is input to the first scanning terminal Gate, and the first transistor T1, the driving transistor Td and the sixth transistor T6 are all in an on state, while the third transistor T3, the fourth transistor T4, the seventh transistor T7, the eighth transistor T8, the ninth transistor T9 and the tenth transistor T10 are all in an off state.

In the light emitting stage, the driving transistor Td controls the driving signal flowing through the first terminal 101 and the second terminal 102 for driving the element to be driven L according to the signal of the control terminal G.

In some embodiments, the driving signal for driving the element to be driven L may be either current or voltage, which is not limited in this embodiment.

The following description is based on the assumption that the driving signal driving the element to be driven L is current. The current driving the element to be driven L is I=K*($V_G$−$V_s$−$V_{th}$)$^2$, where $$K = \frac{1}{2} * \mu * Cox * \frac{W}{L},$$

μ is a migration rate of electrons, Cox is a gate oxide capacitance per unit area, W/L is a width-length ratio of the driving transistor Td, and Vth is a threshold voltage.

$$V_G = 0.5 * V_{Data} + V_{th} \quad \text{formula 1}$$

$$Vs = Vdd \quad \text{formula 2}$$

It may be calculated from the above formula 1 and formula 2 that the current flowing through the light emitting component L is $$I = k * \left(Vdd - \frac{1}{2}V_{data}\right)^2.$$

In this embodiment, in the data writing stage, the voltage division data signal $V_{N1}=0.5*V_{Data}$, and the signal of the control terminal of the driving sub-circuit 10 is set to be $V_G=0.5*V_{Data}+V_{th}$, thus obtaining the above formula of the current flowing through the element to be driven L. With reference to this current formula, the actual data voltage supplied to the element to be driven L is changed from $V_{data}$ to $$\frac{1}{2}V_{data},$$

so it may be seen that the voltage division function of the pixel circuit may be realized by using the pixel circuit provided in this embodiment.

It should be noted that when the pixel circuit provided in this embodiment is used to realize data division in other situations, the design may be specifically based on the pixel circuit provided in this embodiment.

In the light emitting stage, as shown in FIG. 8, because the light emission control terminal EM is input with a low level signal, the ninth transistor T9 and the tenth transistor T10 are turned on, so that the voltage from the first voltage terminal Vdd is applied to the first terminal 101 of the driving sub-circuit 10, the driving sub-circuit 10 controls the driving signal flowing through the first terminal 101 and the second terminal 102 according to the signal of the control terminal G, and the tenth transistor T10 is also turned on because the light emission control signal from the light emission control terminal EM inputs a low level signal, thereby applying the driving signal to the element to be driven L to make the element to be driven L work.

Figure 9C:
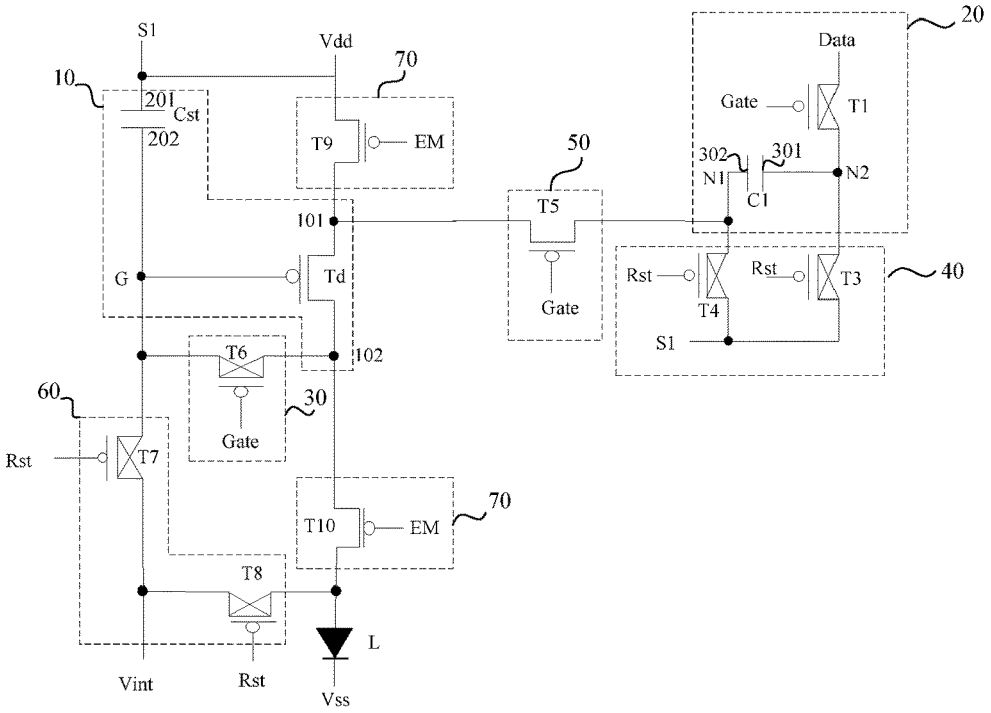
FIG. 9C is a stage diagram of another pixel circuit provided by some embodiments of the disclosure.

As shown in FIG. 9C, the light emission control terminal EM is input with a low level signal, the ninth transistor T9, the driving transistor Td, and the tenth transistor T10 are all in an on state, while the first transistor T1, the third transistor T3, the fourth transistor T4, the sixth transistor T6, the seventh transistor T7, and the eighth transistor T8 are all in an off state.

Figure 10:
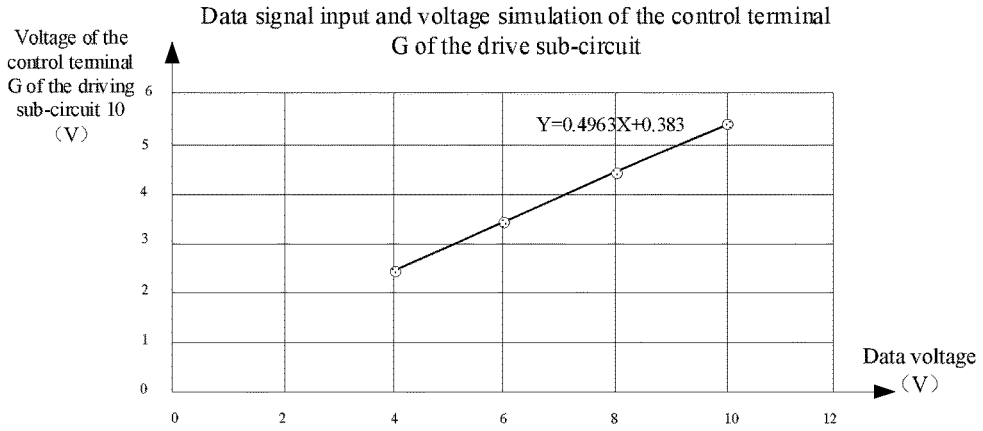
FIG. 10 is a graph showing the relationship between a data voltage and a voltage of a control terminal of a driving sub-circuit provided by some embodiments of the disclosure.

As shown in FIG. 10, the abscissa represents the data voltage supplied by the data signal terminal Data, and the ordinate represents the voltage of the control terminal G of the driving sub-circuit 10. As may be seen from FIG. 10, with the pixel circuit provided in this embodiment, the data voltage written to the control terminal G of the driving sub-circuit 10 is changed from $V_{data}$ $V_{th}$ approximately to $$\frac{1}{2}V_{data} + V_{th}.$$

Figure 11:
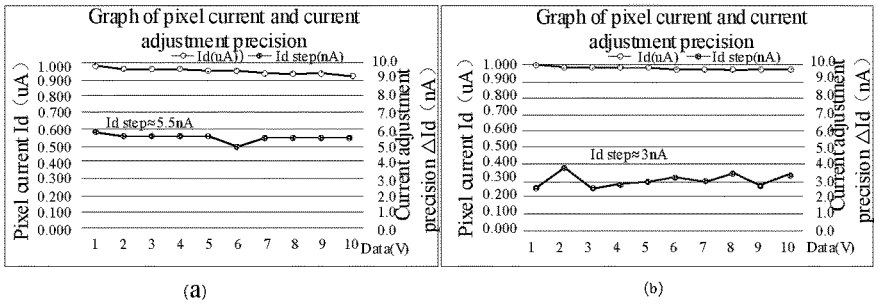
FIG. 11A is a graph of pixel current and current adjustment precision when a pixel circuit of the related art is adopted.
FIG. 11B is a graph of pixel current and current adjustment precision provided by some embodiments of the disclosure.

FIG. 11A is a graph of pixel current and current adjustment precision when a pixel circuit in the prior art is adopted, and FIG. 11B is a graph of pixel current and current adjustment precision when the pixel circuit provided by this embodiment is adopted, where Id represents pixel current, and Id step represents the minimum current interval adjusted by the data voltage. It may be concluded from the figures that the pixel circuit provided in this embodiment may provide smaller adjustment precision of data voltage, thus providing a smaller current interval, and further realizing finer gray scale display.

Figure 12:
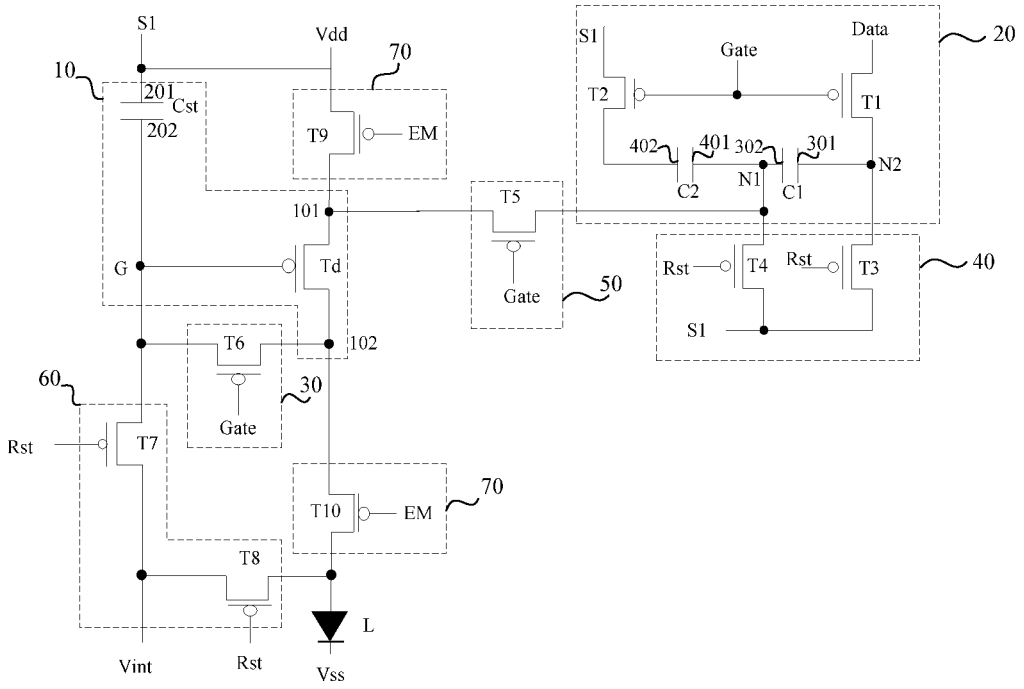
FIG. 12 is a diagram of another pixel circuit provided by some embodiments of the disclosure.

In some other embodiments, as shown in FIG. 12, the voltage division control sub-circuit 20 further comprises a second capacitor C2 and a second transistor T2.

The second capacitor C2 comprises a first pole 401 and a second pole 402, and the first pole 401 of the second capacitor C2 is coupled to the second pole 302 of the first capacitor C1.

A grid of the second transistor T2 is coupled to the first scanning terminal Gate providing the first scanning signal, a first pole of the second transistor T2 is coupled to the first signal terminal S1, and a second pole of the second transistor T2 is coupled to the second pole 402 of the second capacitor C2. After T2 is turned on, the first signal Vcom provided by the first signal terminal S1 may be written to the second pole 402 of the second capacitor C2.

In some embodiments, as shown in FIG. 6, the pixel circuit further comprises a switch control sub-circuit 50 coupled between the voltage division control sub-circuit 20 and the first terminal 101 of the driving sub-circuit 10, and the switch control sub-circuit 50 is configured to control the on-off of a signal transmission channel between the voltage division control sub-circuit 50 and the first terminal 101 of the driving sub-circuit 10 in response to the first scanning signal provided by the first scanning terminal Gate.

Specifically, as shown in FIG. 12, the switch control sub-circuit 50 comprises a fifth transistor T5.

A grid of the fifth transistor T5 is coupled to the first scanning terminal Gate providing the first scanning signal, a first pole is coupled to the second pole 302 of the first capacitor C1, and a second pole is coupled to the first terminal 101 of the driving sub-circuit. After T5 is turned on, the voltage division data signal may be written to the first terminal 101 of the driving sub-circuit 10.

It should be noted that this embodiment does not limit the position of the switch control sub-circuit 50. That is, the switch control sub-circuit 50 may be arranged in the pixel circuit as shown in FIG. 7 and in the pixel circuit as shown in FIG. 12; or, the switch control sub-circuit 50 is arranged in the pixel circuit as shown in FIG. 7; or, the switch control sub-circuit 50 is arranged in the pixel circuit as shown in FIG. 12.

On this basis, with reference to the signal timing diagram shown in FIG. 8, the working principle of the pixel circuit shown in FIG. 12 is illustrated in detail. The working principle of the pixel circuit may be divided into a reset stage, a data writing stage and a light emitting stage. Each stage will be described below.

Figure 13A:
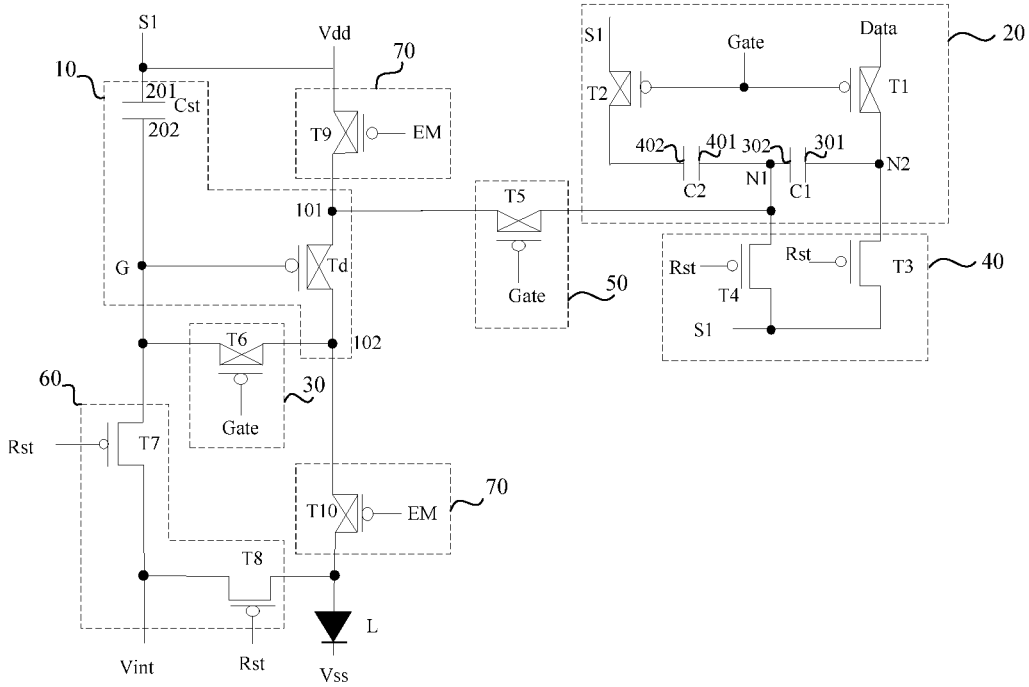
FIG. 13A is a stage diagram of another pixel circuit provided by some embodiments of the disclosure.

In the reset stage, as shown in FIG. 13A, a low level signal is input to the second scanning terminal Rst, the third transistor T3, the fourth transistor T4, the seventh transistor T7 and the eighth transistor T8 are all in an on state, and the driving transistor Td, the first transistor T1, the second transistor T2, the fifth transistor T5, the sixth transistor T6, the ninth transistor T9 and the tenth transistor T10 are all in an off state.

In the data writing stage, because the first scanning terminal Gate is input with a low level signal, the first transistor T1 and the second transistor T2 are turned on, so that the data signal from the data signal terminal Data is transmitted to the first pole 301 of the first capacitor C1, and the first signal Vcom from the first signal terminal S1 is transmitted to the second pole 402 of the second capacitor C2. According to the capacitance division principle of the storage capacitor Cst, the first capacitor C1 and the second capacitor C2, the voltage division data signal of the first node $$N1\ V_{N1} = \left[\frac{C_1 + Cst}{(C1 + C_2 + Cst)}\right] * (V_{Data} - V_{com})$$

may be obtained. When $V_{com}$=0V, Cst=C1=0.5*C2, the voltage at the first node N1$V_{N1}$=0.5·$V_{Data}$. It may be understood that by setting the proportional relationship of the capacitance of the storage capacitor Cst, the capacitance of the first capacitor C1 and the capacitance of the second capacitor C2, the voltage at the first node N1 may be set as the divided voltage of other proportions of the data signal provided by the data signal terminal Data $V_{Data}$, which belongs to the design idea provided by this embodiment of the disclosure.

Because the first scanning terminal Gate is input with a low level signal, the fifth transistor T5 and the sixth transistor T6 are turned on to write the voltage at the first node N1 to the first terminal 101 of the driving sub-circuit 10 and the voltage at the first node N1 to the control terminal G of the driving sub-circuit 10. At this point, the voltage of the control terminal G of the driving sub-circuit 10 $V_G$=0.5*$V_{Data}$+$V_{th}$.

Figure 13B:
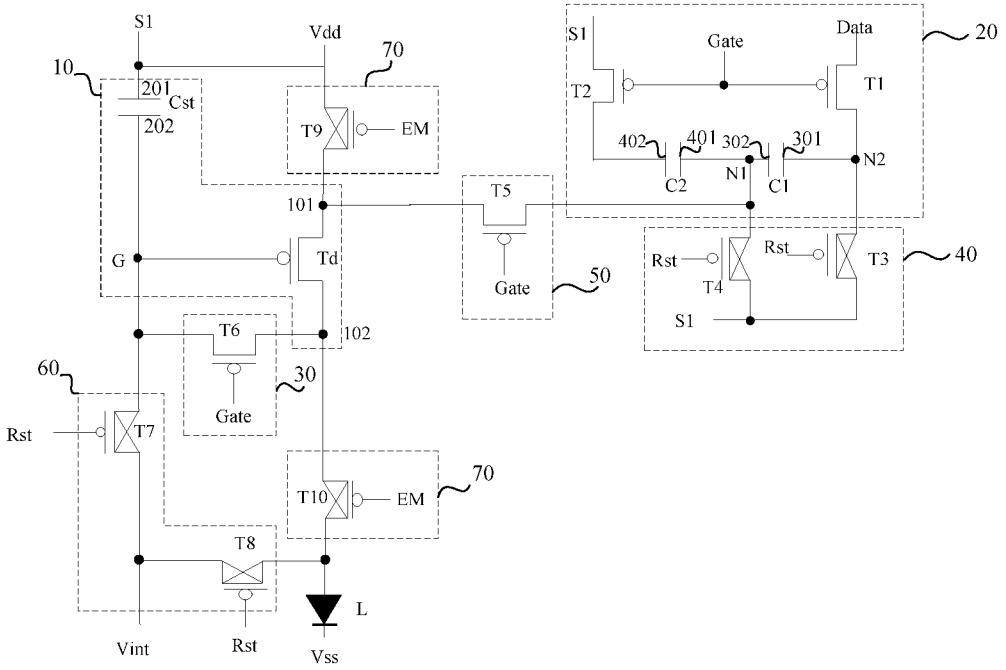
FIG. 13B is a stage diagram of another pixel circuit provided by some embodiments of the disclosure.

As shown in FIG. 13B, a low level signal is input to the first scanning terminal Gate, the first transistor T1, the second transistor T2, the driving transistor Td, the fifth transistor T5 and the sixth transistor T6 are all in an on state, while the third transistor T3, the fourth transistor T4, the seventh transistor T7, the eighth transistor T8, the ninth transistor T9 and the tenth transistor T10 are all in an off state.

Figure 13C:
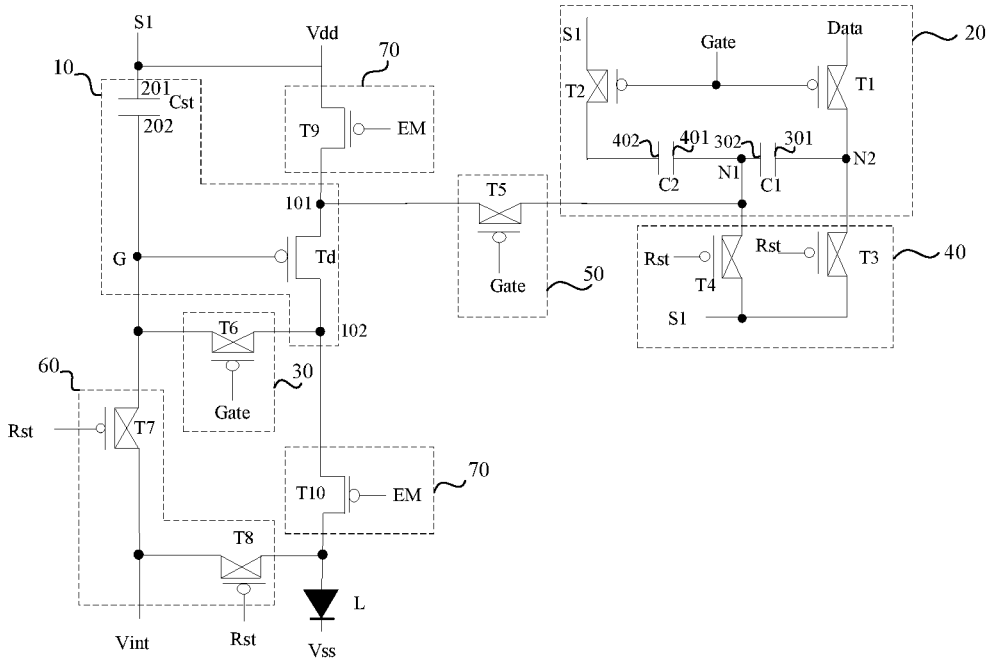
FIG. 13C is a stage diagram of another pixel circuit provided by some embodiments of the disclosure.

In the light emitting stage, as shown in FIG. 13C, the light emission control terminal EM is input with a low level signal, the ninth transistor T9, the driving transistor Td and the tenth transistor T10 are all in an on state, while the first transistor T1, the second transistor T2, the third transistor T3, the fourth transistor T4, the fifth transistor T5, the sixth transistor T6, the seventh transistor T7 and the eighth transistor T8 are all in an off state.

According to the pixel circuit, the driving method thereof and the electronic device provided by the embodiments of the disclosure, the voltage division control sub-circuit conducts voltage division on the input data signal to obtain the voltage division signal, and writes the voltage division signal into the first terminal of the driving sub-circuit; the compensation sub-circuit is coupled between the control terminal of the driving sub-circuit and the second terminal of the driving sub-circuit, so that the voltage division signal passing through the driving sub-circuit may be written into the control terminal of the driving sub-circuit; in this way, a signal of the control terminal of the driving sub-circuit will change, for example, the signal of the control terminal of the driving sub-circuit will decrease, so as to provide a light emitting device with smaller adjustment precision of data voltage required for realizing low gray scale display, thereby fully realizing low gray scale display and further improving the display effect.

Finally, it should be noted that the above embodiments are only used to illustrate the technical solutions of the disclosure, but not to limit the disclosure. Although the disclosure has been described in detail with reference to the foregoing embodiments, those of ordinary skill in the art should understand that the technical solutions described in the foregoing embodiments may still be modified, or some of the technical features may be equivalently replaced, and these modifications or substitutions do not make the essence of the corresponding technical solutions deviate from the spirit and scope of the technical solutions of the embodiments of the disclosure.

The invention claimed is:

1. A pixel circuit for providing a driving signal to an element to be driven, comprising:

a driving sub-circuit comprising a control terminal, a first terminal and a second terminal, the driving sub-circuit being configured to control a driving signal flowing through the first terminal and the second terminal according to a signal of the control terminal;

a voltage division control sub-circuit configured to conduct voltage division on an input data signal in response to a first scanning signal to obtain a voltage division signal, and write the voltage division signal to the first terminal of the driving sub-circuit; and a compensation sub-circuit coupled to the control terminal of the driving sub-circuit and the second terminal of the driving sub-circuit, and configured to write the voltage division signal passing through the driving sub-circuit to the control terminal of the driving sub-circuit in response to the first scanning signal.

2. The pixel circuit according to claim 1, wherein the driving sub-circuit comprises:

a driving transistor having a grid coupled to the control terminal of the driving sub-circuit, a first pole coupled to the first terminal of the driving sub-circuit, and a second pole coupled to the second terminal of the driving sub-circuit; and a storage capacitor comprising a first pole and a second pole, the first pole of the storage capacitor being coupled to a first signal terminal providing a first signal, and the second pole of the storage capacitor being coupled to the control terminal of the driving sub-circuit; and the voltage division control sub-circuit comprises:

a first capacitor comprising a first pole and a second pole, the second pole of the first capacitor being coupled to the first terminal of the driving sub-circuit; and a first transistor having a grid coupled to a first scanning terminal providing the first scanning signal, a first pole coupled to a data signal terminal providing a data signal, and a second pole coupled to the first pole of the first capacitor.

3. The pixel circuit according to claim 2, wherein the voltage division control sub-circuit further comprises:

a second capacitor comprising a first pole and a second pole, the first pole of the second capacitor being coupled to the second pole of the first capacitor; and a second transistor having a grid coupled to the first scanning terminal providing the first scanning signal, a first pole coupled to the first signal terminal, and a second pole coupled to the second pole of the second capacitor.

4. The pixel circuit according to claim 3, wherein the pixel circuit further comprises:

a first reset sub-circuit configured to reset the first pole and the second pole of the first capacitor in response to a second scanning signal.

5. The pixel circuit according to claim 4, wherein the first reset sub-circuit comprises a third transistor and a fourth transistor;

a grid of the third transistor is coupled to a second scanning terminal providing the second scanning signal, a first pole is coupled to the first pole of the first capacitor, and a second pole is coupled to the first signal terminal providing the first signal; and a grid of the fourth transistor is coupled to the second scanning terminal providing the second scanning signal, a first pole is coupled to the second pole of the first capacitor, and a second pole is coupled to the first signal terminal.

6. An electronic device comprising the pixel circuit according to claim 1 and an element to be driven coupled to the pixel circuit.

7. The electronic device according to claim 6, wherein a switch control sub-circuit coupled between the voltage division control sub-circuit and the first terminal of the driving sub-circuit, the switch control sub-circuit being configured to control on-off of a signal transmission channel between the voltage division control sub-circuit and the first terminal of the driving sub-circuit in response to the first scanning signal.

8. The driving method of the pixel circuit according to claim 7, wherein the pixel circuit further comprises a light emission control sub-circuit; and the driving method of the pixel circuit further comprises:

applying, by the light emission control sub-circuit, a voltage of a first voltage terminal to the first terminal of the driving sub-circuit in response to a light emission control signal, so that the driving sub-circuit controls the driving signal flowing through the first terminal and the second terminal according to the signal of the control terminal.

9. A driving method of the pixel circuit according to claim 1, wherein the pixel circuit is configured for providing a driving signal to an element to be driven, and the driving method of the pixel circuit comprises:

conducting, by the voltage division control sub-circuit, voltage division on an input data signal in response to a first scanning signal to obtain a voltage division signal, and writing the voltage division signal to the first terminal of the driving sub-circuit;

writing, by the compensation sub-circuit, the voltage division signal passing through the driving sub-circuit to the control terminal of the driving sub-circuit in response to the first scanning signal; and controlling, by the driving sub-circuit, the driving signal flowing through the first terminal and the second terminal according to a signal of the control terminal.

10. The driving method of the pixel circuit according to claim 9, wherein the pixel circuit further comprises a switch control sub-circuit; and the driving method of the pixel circuit further comprises:

controlling, by the switch control sub-circuit, on-off of a signal transmission channel between the voltage division control sub-circuit and the first terminal of the driving sub-circuit in response to the first scanning signal.

11. The driving method of the pixel circuit according to claim 9, wherein the pixel circuit further comprises a first reset sub-circuit and/or a second reset sub-circuit; and before conducting, by the voltage division control sub-circuit, voltage division on an input data signal in response to a first scanning signal to obtain a voltage division signal, and writing the voltage division signal to the first terminal of the driving sub-circuit, the driving method of the pixel circuit further comprises:

resetting, by the first reset sub-circuit, a first pole and a second pole of a first capacitor in response to a second scanning signal;

and, resetting, by the second reset sub-circuit, the control terminal of the driving sub-circuit and/or a first terminal of the element to be driven.

12. The driving method of the pixel circuit according to claim 9, wherein the pixel circuit further comprises a first reset sub-circuit and/or a second reset sub-circuit; and before conducting, by the voltage division control sub-circuit, voltage division on an input data signal in response to a first scanning signal to obtain a voltage division signal, and writing the voltage division signal to the first terminal of the driving sub-circuit, the driving method of the pixel circuit further comprises:

resetting, by the first reset sub-circuit, a first pole and a second pole of a first capacitor in response to a second scanning signal;

or, resetting, by the second reset sub-circuit, the control terminal of the driving sub-circuit and/or a first terminal of the element to be driven.

13. The pixel circuit according claim 1, wherein the pixel circuit further comprises:

a second reset sub-circuit configured to reset the control terminal of the driving sub-circuit and/or a first terminal of the element to be driven;

and/or, a light emission control sub-circuit configured to apply a voltage of a first voltage terminal to the first terminal of the driving sub-circuit in response to a light emission control signal to apply the driving signal to the element to be driven.

14. The pixel circuit according to claim 13, wherein the second reset sub-circuit comprises a seventh transistor and an eighth transistor;

a grid of the seventh transistor is coupled to the second scanning terminal providing the second scanning signal, a first pole is coupled to an initial signal terminal providing an initial signal, and a second pole is coupled to the control terminal of the driving sub-circuit; and a grid of the eighth transistor is coupled to the second scanning terminal, a first pole is coupled to the first terminal of the element to be driven, and a second pole is coupled to the initial signal terminal;

the light emission control sub-circuit comprises a ninth transistor and a tenth transistor;

a grid of the ninth transistor is coupled to a light emission control terminal providing the light emission control signal, a first pole is coupled to the first voltage terminal, and a second pole is coupled to the first terminal of the driving sub-circuit; and a grid of the tenth transistor is coupled to the light emission control terminal, a first pole is coupled to the second terminal of the driving sub-circuit, and a second pole is coupled to the first terminal of the element to be driven.

15. The pixel circuit according to claim 13, wherein the second reset sub-circuit comprises a seventh transistor and an eighth transistor;

a grid of the seventh transistor is coupled to the second scanning terminal providing the second scanning signal, a first pole is coupled to an initial signal terminal providing an initial signal, and a second pole is coupled to the control terminal of the driving sub-circuit; or a grid of the eighth transistor is coupled to the second scanning terminal, a first pole is coupled to the first terminal of the element to be driven, and a second pole is coupled to the initial signal terminal;

the light emission control sub-circuit comprises a ninth transistor and a tenth transistor;

a grid of the ninth transistor is coupled to a light emission control terminal providing the light emission control signal, a first pole is coupled to the first voltage terminal, and a second pole is coupled to the first terminal of the driving sub-circuit; and a grid of the tenth transistor is coupled to the light emission control terminal, a first pole is coupled to the second terminal of the driving sub-circuit, and a second pole is coupled to the first terminal of the element to be driven.

16. The pixel circuit according to claim 1, wherein the pixel circuit further comprises:

a switch control sub-circuit coupled between the voltage division control sub-circuit and the first terminal of the driving sub-circuit, the switch control sub-circuit being configured to control on-off of a signal transmission channel between the voltage division control sub-circuit and the first terminal of the driving sub-circuit in response to the first scanning signal.

17. The pixel circuit according to claim 16, wherein the switch control sub-circuit comprises a fifth transistor; and a grid of the fifth transistor is coupled to the first scanning terminal providing the first scanning signal, a first pole is coupled to the second pole of the first capacitor, and a second pole is coupled to the first terminal of the driving sub-circuit.

18. The pixel circuit according to claim 1, wherein the compensation sub-circuit comprises a sixth transistor; and the sixth transistor is coupled to the first scanning terminal providing the first scanning signal, a first pole is coupled to a second terminal of the driving sub-circuit, and a second pole is coupled to the control terminal of the driving sub-circuit.

* * * * *